US005587355A

United States Patent [19]

Beltzer et al.

[11] Patent Number: 5,587,355

[45] Date of Patent: Dec. 24, 1996

[54] HIGH LOAD-CARRYING TURBO OILS CONTAINING AMINE PHOSPHATE AND THIOPHENE CARBOXYLIC ACID DERIVATIVES

[75] Inventors: Morton Beltzer, Westfield; Paul J. Berlowitz, East Windsor; Jeenok T. Kim, Holmdel, all of N.J.

[73] Assignee: Exxon Research and Engineering Company, Florham Park, N.J.

[21] Appl. No.: 577,659

[22] Filed: Dec. 22, 1995

[51] Int. Cl.[6] ..... C10M 141/10; C10M 141/08; C10M 135/32; C10M 137/08

[52] U.S. Cl. ..... 508/302; 508/437

[58] Field of Search ..... 252/32.5, 48.6

[56] References Cited

U.S. PATENT DOCUMENTS

| | | | |
|---|---|---|---|
| 2,549,600 | 4/1951 | Hartough | 260/332.3 |
| 2,562,238 | 7/1951 | Lukasiewicz et al. | 260/332.3 |
| 2,610,191 | 9/1952 | Toland | 260/329 |
| 3,391,161 | 7/1968 | Larimer | 260/332.2 |
| 3,642,631 | 2/1972 | Gisser et al. | 252/48.4 |
| 3,859,218 | 1/1975 | Jervis et al. | 252/32.5 |
| 4,130,494 | 12/1978 | Shaub et al. | 252/32.5 |
| 4,193,882 | 3/1980 | Gemmill, Jr. | 252/47.5 |
| 4,536,308 | 8/1985 | Pehler et al. | 252/32.7 E |
| 5,055,584 | 10/1991 | Karol | 548/142 |
| 5,395,538 | 3/1995 | Rudnick et al. | 252/45 |

FOREIGN PATENT DOCUMENTS

| | | | |
|---|---|---|---|
| 434464 | 6/1991 | European Pat. Off. . | |
| 0434464A1 | 6/1972 | United Kingdom | C10M 3/40 |

*Primary Examiner*—Margaret Medley
*Attorney, Agent, or Firm*—Joseph J. Allocca

[57] ABSTRACT

This invention relates to synthetic based turbo oils, preferably polyol ester-based turbo oils which exhibit exceptional load-carrying capacity by use of a synergistic combination of sulfur (S)-based and phosphorous (P)-based load additives. The S-containing additive of the present invention is thiophene carboxylic acid (TCA) derivatives, preferably TCA per se or thiophene $C_1$–$C_4$ alkanoic acid and the P-containing additive is one or more amine phosphate(s). The turbo oil composition consisting of the dual P/S additives of the present invention achieves an excellent load-carrying capacity, which is better than or equivalent to that obtained when each additive was used alone at a higher treat rate than the total P/S additive combination treat rate, and this lower concentration requirement of the P and S additive allows the turbo oil composition to meet or exceed US Navy MIL-L-23699 requirements including Oxidation and Corrosion Stability and Si seal compatibility.

9 Claims, No Drawings

HIGH LOAD-CARRYING TURBO OILS CONTAINING AMINE PHOSPHATE AND THIOPHENE CARBOXYLIC ACID DERIVATIVES

BACKGROUND OF THE INVENTION

1. Field of the Invention

This invention relates to synthetic oil-based, preferably polyol ester-based turbo oils which use a synergistic combination of phosphorous (P)-based and sulfur (S)-based load additive chemistries which allows the turbo oil formulation to impart high load-carrying capacity and also to meet or exceed US Navy MIL-L-23699 requirements including Oxidation and Corrosion Stability and Si seal compatibility.

Load additives protect metal surfaces of gears and bearings against uncontrollable wear and welding as moving parts are heavily loaded or subjected to high temperatures. Incorporating high load-carrying capacity into a premium quality turbo oil without adversely impacting other properties can significantly increase the service life and reliability of the turbine engines.

The mechanism by which load additives function entails an initial molecular adsorption on metal surfaces followed by a chemical reaction with the metal to form a sacrificial barrier exhibiting reduced friction between the rubbing metal surfaces. In the viewpoint of this action, the effectiveness as load-carrying agent is determined by the surface activity imparted by a polar functionality of a load additive and its chemical reactivity toward the metal; these features can lead to a severe corrosion if not controlled until extreme pressure conditions prevail. As a result, the most of effective load additives carry deleterious side effects on other key turbo oil performances: e.g., corrosion, increased deposit forming tendency and elastomer incompatibility.

DESCRIPTION OF THE PRIOR ART

U.S. Pat. No. 5,395,538 teaches the use of alkylated thiophene for high temperature stable lubricant fluids having excellent thermal stability, antiwear and load-carrying properties, and excellent additive solubility.

U.S. Pat. No. 3,642,631-A discloses a lubricating oil or hydraulic fluid composition containing substituted bithiophene used as friction-reducing agent.

EP 434,464 is directed to lube composition or additive concentrate comprising metal-free antiwear and load-carrying additives containing sulfur and/or phosphorous, and an amino-succinate ester corrosion inhibitor. The antiwear and load additives include mono- or di-hydrocarbyl phosphate or phosphite with the alkyl radical containing up to $C_{12}$, or an amine salt of such a compound, or a mixture of these; or mono- or dihydrocarbyl thiophosphate where the hydrocarbon (HC) radical is aryl, alkylaryl, arylalkyl or alkyl, or an amine salt thereof; or trihydrocarbyl dithiophosphate in which each HC radical is aromatic, alkylaromatic, or aliphatic; or amine salt of phosphorothioic acid; optionally with a dialkyl polysulfide and/or a sulfurized fatty acid ester.

U.S. Pat. No. 4,130,494 discloses a synthetic ester lubricant composition containing ammonium phosphate ester and ammonium organo-sulfonate, especially useful as aircraft turbine lubricants. The afore-mentioned lubricant composition have good extreme pressure properties and good compatibility with silicone elastomers.

U.S. Pat. No. 3,859,218 is directed to high pressure lube composition comprising a major portion of synthetic ester and a minor portion of load-beating additive. The load-carrying additive package contains a mixture of a quaternary ammonium salt of mono-($C_1$–$C_4$) alkyl dihydrogen phosphate and a quaternary ammonium salt of di-($C_1$–$C_4$) alkyl monohydrogen phosphate. In addition to the improved high pressure and wear resistance, the lubricant provides better corrosion resistance and cause less swelling of silicone rubbers than known oils containing amine salts of phosphoric and thiophosphoric acids.

DETAILED DESCRIPTION

A turbo oil having unexpectedly superior load-carrying capacity comprises a major portion of a synthetic base oil selected from diesters and polyol ester base oil, preferably polyol ester base oil, and minor portion of a load additive package comprising a mixture of one or more amine phosphate and thiophene carboxylic acid (TCA), its derivatives and mixtures thereof.

The diester, which can be used in the high load-carrying lube composition of the present invention is formed by esterification of linear or branched $C_6$ to $C_{15}$ aliphatic alcohols with one of such dibasic acids as sebacic, adipic, azelaic acids. Examples of diester are di-2-ethyhexyl sebacate, di-octyl adipate.

The preferred synthetic base stock which is synthetic polyol ester base oil is formed by the esterification of aliphatic polyols with carboxylic acids. The aliphatic polyols contain from 4 to 15 carbon atoms and have from 2 to 8 esterifiable hydroxyl groups. Examples of polyols are trimethylolpropane, pentaerythritol, dipentaerythritol, neopentyl glycol, tripentaerythritol and mixtures thereof.

The carboxylic acid reactants used to produce the synthetic polyol ester base oil are selected from aliphatic monocarboxylic acids or a mixture of aliphatic monocarboxylic acids and aliphatic dicarboxylic acids. The carboxylic acids contain from 4 to 12 carbon atoms and includes the straight and branched chain aliphatic acids, and mixtures of monocarboxylic acids may be used.

The preferred polyol ester base oil is one prepared from technical pentaerythritol and a mixture of $C_4$–$C_{12}$ carboxylic acids. Technical pentaerythritol is a mixture which includes about 85 to 92% monopentaerythritol and 8 to 15% dipentaerythritol. A typical commercial technical pentaerythritol contains about 88% monopentaerythritol having the structural formula

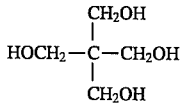

and about 12% of dipentaerythritol having the structural formula

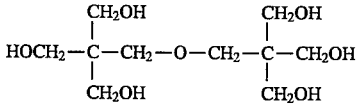

The technical pentaerythritol may also contain some tri and tetra pentaerythritol that is normally formed as by-products during the manufacture of technical pentaerythritol.

The preparation of esters from alcohols and carboxylic acids can be accomplished using conventional methods and techniques known and familiar to those skilled in the art. In general, technical pentaerythritol is heated with the desired carboxylic acid mixture optionally in the presence of a catalyst. Generally, a slight excess of acid is employed to force the reaction to completion. Water is removed during the reaction and any excess acid is then stripped from the reaction mixture. The esters of technical pentaerythritol may be used without further purification or may be further purified using conventional techniques such as distillation.

For the purposes of this specification and the following claims, the term "technical pentaerythritol ester" is understood as meaning the polyol ester base oil prepared from technical pentaerythritol and a mixture of $C_4$–$C_{12}$ carboxylic acids.

As previously stated, to the synthetic oil base stock is added a minor portion of an additive comprising a mixture of one or more amine phosphate(s) and TCA, its derivatives, and mixtures thereof.

The amine phosphate used includes commmercially available monobasic hydrocarbyl amine salts of mixed mono- and di-acid phosphates and specialty amine salt of the diacid phosphate. The mono- and di-acid phosphate amines have the structural formula:

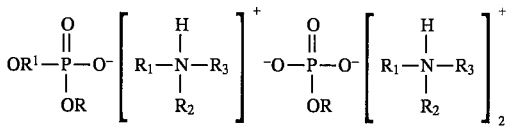

where

R and $R^1$ are the same or different and are $C_1$ to $C_{12}$ linear or branched chain alkyl $R_1$ and $R_2$ are H or $C_1$ to $C_{12}$ linear or branched chain alkyl $R_3$ is $C_4$ to $C_{12}$ linear or branched chain alkyl, or aryl-$R_4$ or $R_4$-aryl where $R_4$ is H or $C_1$–$C_{12}$ alkyl, and aryl is $C_6$.

The preferred amine phosphates are those wherein R and $R^1$ are $C_1$–$C_6$ alkyl, and $R_1$ and $R_2$ are H or $C_1$–$C_4$, and $R_3$ is aryl-$R_4$ where $R_4$ is linear chain $C_4$–$C_{12}$ alkyl or $R_3$ is linear or branched chain $C_8$–$C_{12}$ alkyl.

The molar ratio of the monoacid to diacid phosphate amine in the commmercial amine phosphates of the present invention ranges from 1:3 to 3:1.

Mixed mono-/di-acid phosphate and just diacid phosphate can be used, with the latter being the preferred.

The amine phosphates are used in an amount by weight in the range 50 to 300 ppm (based on base stock), preferably 75 to 250 ppm, most preferably 100 to 200 ppm amine phospate.

Materials of this type are available commercially from a number of sources including R.T. Vanderbilt (Vanlube series) and Ciba Geigy.

TCA and its derivatives, the sulfur containing additive used in this invention is described by the structural formula:

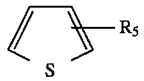

where $R_5$ is COOH or $C_1$–$C_{12}$ linear alkanoic acid (hereafter collectively referred to as TCA derivatives).

The preferred TCA derivatives are wherein R is COOH or $C_1$–$C_4$ linear alkanoic acid.

The TCA derivative is used in an amount by weight in the range 100 to 1000 ppm (based on polyol ester base stock), preferably 150 to 800 ppm, most preferably 250 to 500 ppm.

The amine phosphate and the TCA derivative are used in the weight ratio of 1:1 to 1:10, preferably 1:1.5 to 1:5, most preferably 1:2 to 1:3 amine phosphate:TCA derivative.

The synthetic oil based, preferably polyol ester-based high load-carrying oil may also contain one or more of the following classes of additives: antioxidants, antifoamants, antiwear agents, corrosion inhibitors, hydrolytic stabilizers, metal deactivator, detergents. Total amount of such other additives can be in the range 0.5 to 15 wt %, preferably 2 to 10 wt %, most preferably 3 to 8 wt %.

Antioxidants which can be used include aryl amines, e.g., phenyl-naphthylamines and dialkyl diphenyl amines and mixtures thereof, hindered phenols, phenothiazines, and their derivatives.

The antioxidants are typically used in an amount in the range 1 to 5%.

Antiwear additives include hydrocarbyl phosphate esters, particularly trihydrocarbyl phosphate esters in which the hydrocarbyl radical is an aryl or alkaryl radical or mixture thereof. Particular antiwear additives include tricresyl phosphate, t-butyl phenyl phosphates, trixylenyl phosphate, and mixtures thereof.

The antiwear additives are typically used in an mount in the range 0.5 to 4 wt %, preferably 1 to 3 wt %.

Corrosion inhibitors include, but are not limited to, various triazols, e.g., tolyl triazol, 1,2,4-benzene triazol, 1,2,3-benzene triazol, carboxy benzotriazole, alkylated benzotriazol and organic diacids, e.g., sebacic acid.

The corrosion inhibitors can be used in an amount in the range 0.02 to 0.5 wt %, preferably 0.05% to 0.25 wt %.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, pages 1–11, the disclosures of which are incorporated herein by reference.

The turbo oils of the present invention exhibit excellent load-carrying capacity as demonstrated by the severe FZG gear test, while meeting or exceeding the Oxidation and Corrosion Stability (OCS) and Si seal compatibility requirements set out by the United States Navy in MIL-L-23699 Specification. The polyol ester-based turbo oils to which have been added a synergistic mixture of the amine phosphate and the TCA derivative produce a significant improvement in antiscuffing protection of heavily loaded gears over that of the same formulations in the absence of the amine phosphate and the TCA derivative, and furthermore, attain the load-carrying capability better than or equivalent to that achieved with one of these two additives used alone at the higher treat rate than the total P/S additive combination treat rate.

The present invention is further described by reference to the following non-limiting examples.

EXPERIMENTAL

In the following examples, a series of fully formulated aviation turbo oils were used to illustrate the performance benefits of using a mixture of the amine phosphate and TCA derivative in the load-carrying, OCS and Si seal tests. A polyol ester base stock prepared by reacting technical pentaerythritol with a mixture $C_5$ to $C_{10}$ acids was employed along with a standard additive package containing from 1.7–2.5% by weight aryl amine antioxidants, 0.5–2% tri-aryl phosphates, and 0.1% benzo or alkyl-benzotriazole. To this was added various load-carrying additive package which consisted of the following:

1) Amine phosphate alone: Vanlube 692, a mixed mono-/di-acid phosphate amine, sold commercially by R.T. Vanderbilt 2) TCA derivative alone: thiophene carboxylic acid (TCA) or thiophene acetic acid (TAA), both commercially available from numerous chemical suppliers such as Sigma, Aldrich, etc.

3 ) Combination (present invention): the combination of the two materials described in (1) and (2).

The load-carrying capacity of these oils was evaluated in the severe FZG gear test. The FZG gear test is an industry standard test to measure the ability of an oil to prevent scuffing of a set of moving gears as the load applied to the gears is increased. The "severe" FZG test mentioned here is distinguished from the FZG test standardized in DIN 51 354 for gear oils in that the test oil is heated to a higher temperature (140 versus 90° C.), and the maximum pitch line velocity of the gear is also higher (16.6 versus 8.3 m/s). The FZG performance is reported in terms of failure load stage (FLS), which is defined by a lowest load stage at which the sum of widths of all damaged areas exceeds one tooth width of the gear. Table 1 lists Hertz load and total work transmitted by the test gears at different load stages.

TABLE 1

| Load Stage | Hertz Load (N/mm$^2$) | Total Work (kWh) |
|---|---|---|
| 1 | 146 | 0.19 |
| 2 | 295 | 0.97 |
| 3 | 474 | 2.96 |
| 4 | 621 | 6.43 |
| 5 | 773 | 11.8 |
| 6 | 927 | 19.5 |
| 7 | 1080 | 29.9 |
| 8 | 1232 | 43.5 |
| 9 | 1386 | 60.8 |
| 10 | 1538 | 82.0 |

The OCS [FED-STD-791; Method 5308 @400° F.] and Si seal [FED-STD-791; Method 3433] tests used here to evaluate the turbo oils were run under the standard conditions as required by the Navy MIL-L-23699 specification.

The results from the severe FZG, Si seal and OCS tests are shown in Tables 2, 3 and 4, respectively. The wt % concentrations (based on the polyol ester base stock) of the amine phosphate and TCA or TAA, either used alone or in combination are also specified in the tables. Table 2 demonstrates that the combination of the amine phosphate and the TCA or TAA exhibits an excellent load-carrying capacity, which is better than or comparable to that attributed to each additive used alone at a significantly higher treat rate than that of the P/S additive combination. Tables 3 and 4 show that the turbo oil fomulation containing the synergistic P/S load additive combination also meets or exceeds the MIL-L-23699 OCS and Si seal specifications whereas 0.1% VL 692-containing formulation fails the Si seal test and yields only the equivalent FZG performance to that of the present invention.

TABLE 2

| Load Additives | Severe FZG FLS |
|---|---|
| None | 4 |
| 0.02 wt % Vanlube 692 (VL 692) | 5.3 (average of 6 runs) |
| 0.05 wt % TAA | 5 |
| 0.10 wt % TCA | 6 |
| 0.10 wt % VL 692 | 7–8 |
| 0.03 wt % TAA + 0.02% VL 692 | 7 |
| 0.05 wt % TCA + 0.02% VL 692 | 7–8 |

TABLE 3

| | MIL-23699-OCS Test @ 400° F. | | | | |
|---|---|---|---|---|---|
| Load Additives | % Vis Change | Δ TAN (mg KOH/g oil) | Sludge (mg/100 cc) | Δ Cu (mg/cm$^2$) | Δ Ag (mg/cm$^2$) |
| None | 14.45 | 0.83 | 0.7 | −0.07 | −0.02 |
| 0.05% TAA + 0.02% VL 692 | 9.44 | 0.18 | 0.4 | −0.05 | −0.02 |
| Limits | −5–25 | 3 | 50 | ±0.4 | ±0.2 |

TABLE 4

| | Si Seal Compatibility | |
|---|---|---|
| Load Additives | Δ Swell | % Tensile Strength Loss |
| None | 13.1 | 10.3 |
| 0.1% VL 692 | 3.9 | 84.4 |
| 0.02% VL 692 | 7.8 | 28.7 |
| 0.05 TAA + 0.02% VL 692 | 7.9 | 24.6 |
| Spec | 5–25 | <30 |

What is claimed is:

1. A turbo oil comprising a major mount of a base stock suitable for use as a turbo oil base stock comprising synthetic polyol ester and a minor mount of additives comprising a mixture of thiophene carboxylic acid (TCA) derivative represented by the structural formula

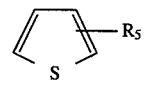

where $R_5$ is COOH or linear $C_1$–$C_{12}$ alkanoic acid and one or more amine phosphate(s) wherein the amine phosphate is moaobasic hydrocarbyl amine salts of mixed mono- and di-acid phosphates, wherein the amine phosphate and TCA derivative are used in a weight ratio of 1:1 to 1:10, and wherein the TCA derivative is present in an mount by weight in the range 100 to 1,000 ppm and the amine phosphate is present in an amount in the range 50 to 300 ppm all based on base stock.

2. The turbo oil of claim 1 wherein the $R_5$ is COOH or $C_1$–$C_4$ alkanoic acid.

3. The turbo oil of claim 1 wherein the amine phosphate and the TCA derivative are used in a weight ratio of 1:1.5 to 1.5.

4. The turbo oil of claim 1, 2, or 3 wherein the amine phosphate is monobasic hydrocarbyl amine salt of the diacid phosphate.

5. The turbo oil of claim 1 wherein the amine phosphate is of the formula

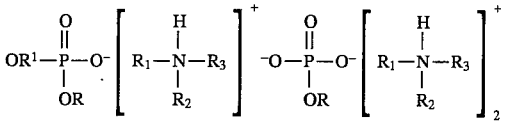

where

R and $R^1$ are the same or different and are $C_1$ to $C_{12}$ linear or branched chain alkyl;

$R_1$ and $R_2$ are H or $C_1$–$C_{12}$ linear or branched chain alkyl;

$R_3$ is $C_4$ to $C_{12}$ linear or branched chain alkyl or aryl-$R_4$ or $R_4$-aryl where $R_4$ is H or $C_1$–$C_{12}$ alkyl, and aryl is $C_6$.

6. The turbo oil of claim 5 wherein R and $R^1$ are $C_1$ to $C_6$ alkyl, and $R_1$ and $R_2$ are H or $C_1$–$C_4$, and $R_3$ is aryl-$R_4$ where $R_4$ is linear chain $C_4$–$C_{12}$ alkyl; or $R_3$ is linear or branched $C_8$–$C_{12}$ alkyl, and aryl is $C_6$.

7. The turbo oil of claim 1,2, or 3 wherein the TCA derivative is present in an amount by weight in the range 150 to 800 ppm and the amine phosphate is present in an mount in the range 75 to 250 ppm.

8. The turbo oil of claim 1, 2 or 3 wherein the TCA derivative is present in an amount by weight in the range 250 to 500 ppm and the amine phosphate is present in an mount in the range 100 to 200 ppm.

9. The turbo oil of claim 8 wherein the amine phosphate and the TCA derivative are used in a weight ratio of 1:2 to 1:3.

* * * * *